US005996152A

United States Patent [19]

Wilson

[11] Patent Number: 5,996,152

[45] Date of Patent: Dec. 7, 1999

[54] SLEEP PROMOTING AND COMFORTING DEVICE FOR INFANTS

[76] Inventor: Rachel J. Wilson, 3654 S. Marlborough Dr., Tucker, Ga. 30084

[21] Appl. No.: 08/852,279

[22] Filed: May 7, 1997

[51] Int. Cl.[6] ..... A61F 5/045

[52] U.S. Cl. ..... 5/655; 5/640

[58] Field of Search ..... 5/655, 482, 492, 5/640, 485, 636; 446/330, 369, 370

[56] References Cited

U.S. PATENT DOCUMENTS

| | | | |
|---|---|---|---|
| D. 310,929 | 10/1990 | Blau | 5/485 |
| 2,614,365 | 10/1952 | Musselwhite et al. | 446/330 |
| 2,961,668 | 11/1960 | Hayes | 5/640 |
| 3,506,988 | 4/1970 | Saddoris | 5/492 |
| 3,809,065 | 5/1974 | Gatts | 128/1 R |
| 4,197,604 | 4/1980 | Nakamura | 5/640 |
| 4,577,358 | 3/1986 | Glass | 5/455 |
| 4,590,633 | 5/1986 | Pickens | 5/485 |
| 4,607,403 | 8/1986 | Alivizatos | 5/482 |
| 4,969,869 | 11/1990 | Burgin et al. | 604/23 |
| 5,027,457 | 7/1991 | Sweet | 5/640 |
| 5,272,780 | 12/1993 | Clute | 5/655 |
| 5,470,270 | 11/1995 | Beamon et al. | 446/330 |
| 5,499,418 | 3/1996 | Tan et al. | 5/655 |
| 5,581,832 | 12/1996 | Bridley | 5/655 |

*Primary Examiner*—Michael Trettel
*Assistant Examiner*—Fredrick Conley
*Attorney, Agent, or Firm*—Barry E. Kaplan, Esq.; Hughes & Kaplan

[57] ABSTRACT

A sleep promoting and comforting device for infants having a cavity partially filled with a freely flowable material. The cavity is placed on the torso of an infant lying in any position. A plurality of appendages extend from the cavity of the device. Both the cavity and appendages have the capacity to contain enough freely flowable material to provide adequate pressure to an infant's torso. The appendages are of sufficient length to extend partially around the arms of an infant, and they may contain flexible rod-like structures that allow them to remain bent around the upper arms and waist of a sleeping infant. An attaching means enables the comforting device to remain secured on the infant's torso so as not to slip and pose a threat of suffocation. This device comforts infants lying on flat surfaces by providing continual gentle pressure to the torso and subtle restraint to the arms.

23 Claims, 6 Drawing Sheets

SLEEP PROMOTING AND COMFORTING DEVICE FOR INFANTS

BACKGROUND

1. Field of Invention

This invention relates to devices used to restrain infants, specifically to such devices that comfort sleeping infants by providing continual gentle pressure to the torso and subtle restraint to the arms.

2. Description of Prior Art

Infants have a reflex often referred to as the "Moro" or "startle" reflex that begins at birth and can continue until 6 months of age. This reflex is characterized by a sudden extension of the infant's arms and stiffening of the body—the infant appears to be falling. Infants are unlikely to startle when cradled and restrained in parents' arms; startling occurs more frequently when the infant is placed on a firm surface (e.g., a bed, the floor, or a couch). Because infants must spend long stretches of time sleeping on such surfaces, infant startling can disturb sleep. In addition, physicians currently recommend that babies be put to sleep on their backs to reduce the risk for Sudden Infant Death Syndrome; this position tends to give infants an even weaker sense of security, thus creating conditions conducive for infant startling.

Traditionally, parents have "swaddled" infants to provide them with a sense of security by wrapping them tightly in a blanket. This method, while effective in providing comfort, can be much too restraining (especially in warm climates); older infants as well as many newborns are averse to being swaddled.

The prior art that I have uncovered has followed two different veins: a) electronic comforting devices and b) pillows that provide support to infants. The first type of comforting device—those that are electronic—is reflected in two patents. U.S. Pat. No. 3,809,065, issued in 1974 to Gatts, reveals an "infant environmental transition system." This system may be comforting to infants; however, it is highly complex and involves electronics, thus rendering the system expensive to manufacture and cumbersome for parents to operate. Similarly, U.S. Pat. No. 4,969,869, issued in 1990 to Cohen, is called a "sleep promoting and/or pacification apparatus." This invention also is electronic and thus adds expense for the consumer. This invention does not provide any type of restraint for the infant.

The second type of comforting device is referred to as a support pillow in most of the related patents. U.S. Pat. Nos. 5,272,780 (Clute, 1993), 5,581,832 (Bridley, 1996), and 5,499,418 (Tan, 1996) all disclose some device that provides infant support and comfort. However, all of these inventions involve a device that infants must lay on top of—not inventions that lay on top of the infant. Although these devices may comfort sleeping infants, the caregiver must be prepared to use such a device before placing an infant down to sleep. In other words, if the device weren't in a handy location, the caregiver would be forced to either retrieve the device and delay putting the infant down or forgo use of the device altogether. Also, these infant support devices are all designed specifically to accommodate side-sleeping infants. An infant sleeping on her back would not be comforted by this device. However, pediatricians currently recommend putting babies to sleep on their backs—side-sleeping is no longer acceptable because of the risk for suffocation if the newborn were to roll over on to the stomach.

U.S. Pat. No. 5,272,780 also does not specifically restrain the arms. The patent states that the infant's arms can "extend out one open end of the channel." Subtle restraint to the arms may provide an increased sense of security. None of the previously mentioned patents address the problem of infant waking caused by the startle reflex.

U.S. Pat. No. 4,577,358 issued to Glass in 1985 discloses a "bean bag body support." This support is comprised of a bean-bag—like structure and a fastener means for reducing the size of the bean bag. The purpose of this support is to provide comfort to dental patients while lying in a dental chair. The bag is not intended or suited for comforting a sleeping infant. It lacks any type of attaching means for securing the bag to other objects.

OBJECTS AND ADVANTAGES

Accordingly, several objects and advantages of my sleep promoting and comforting device are:

a) to provide a device that will give an infant a sense of security while lying on flat surfaces by providing continual gentle pressure and subtle restraint;

b) to provide a device for combating the occurrence of the startle reflex in sleeping infants, thus promoting sleep;

c) to provide a device for comforting infants that is inexpensive to manufacture and is therefore affordable to consumers;

d) to provide a device for comforting infants that is extremely simple and convenient for caregivers to use;

e) to provide a device for comforting infants that is small enough to be easily transported; and f) to provide a device for comforting infants that will not slip out of position and thus will not pose a threat of suffocation to the infant.

Other objects and advantages include the shape of the comforting device, which can easily be designed to resemble objects that babies find appealing (e.g., teddy bears, turtles, cows, and frogs). This provides a visual advantage to my comforting device; this device can be continued to be enjoyed as a toy as an infant gets older. Also, because of the flexible nature of the materials, the comforting device will contour the body of any sized infant, while lying in any position (i.e., on the stomach, side, or back).

SUMMARY

This invention is a device used to comfort sleeping infants by providing gentle pressure to the torso and subtle restraint to the arms. The invention comprises a cavity partially filled with a freely flowable material. The cavity is placed on the torso of an infant lying in any position. A plurality of appendages may extend from the cavity of the device. Both the cavity and the apendages have the capacity to contain enough freely flowable material to provide adequate pressure to an infant's torso. The appendages are of sufficient length to extend partially around at least one arm of an infant. The appendages may contain flexible rod-like structures that allow them to remain around the upper arm and the waist of a sleeping infant. Attaching means enable the comforting device of the present invention to remain secured upon the infant's torso so as not to slip and pose a threat of suffocation.

DESCRIPTION OF INVENTION

This invention is a device used to comfort a sleeping infant by providing gentle pressure to the torso and subtle restraint to the arms. The shape of this device resembles the body of a person or animal (i.e., a torso with two extending arms and legs). This shape allows the comforting device potentially to be designed to resemble objects that are appealing to infants—such as teddy bears and other animals. Caregivers can continue to use the device as a toy when an infant outgrows the need for the type of comfort that the device provides (see FIG. 6).

Figure 1:
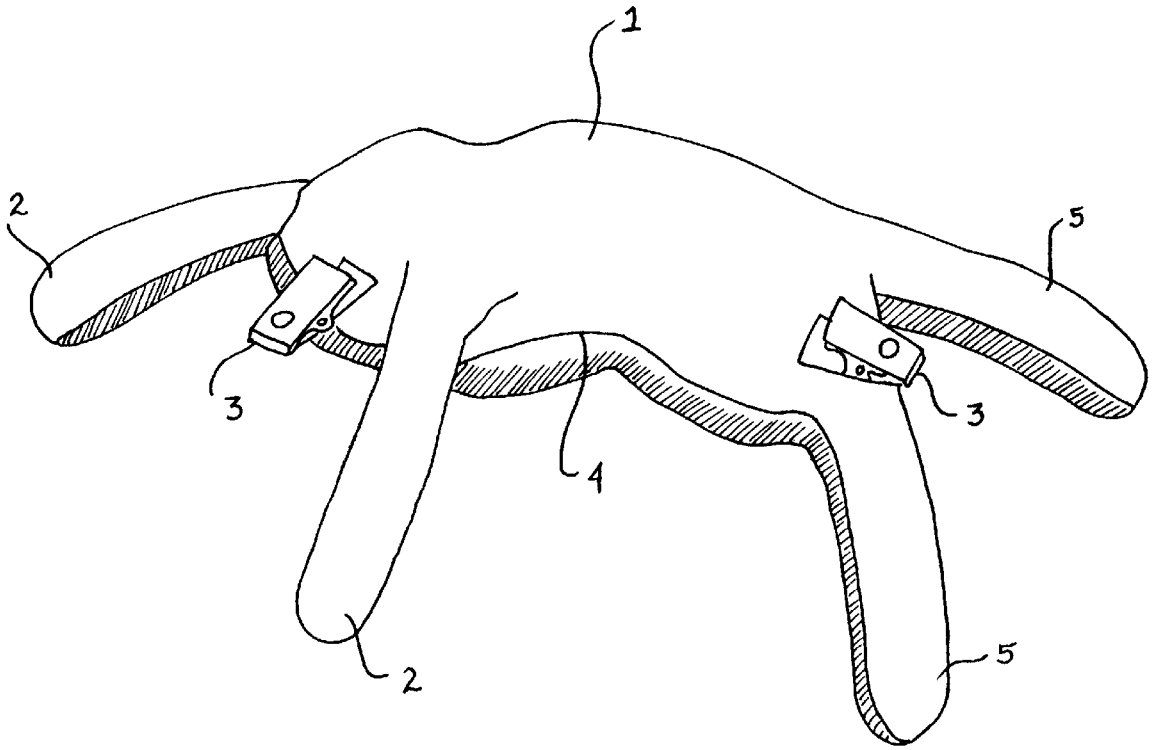
FIG 1 shows a perspective view of the comforting device of the present invention.

In FIG. 1, the comfort device is shown from a perspective view, and the external shape and features are revealed. Upper appendages 2 as shown in FIG. 1 are long enough to extend partially around an infant's arms (when an infant is lying on his/her back) or around most of the torso, including the upper portion of one arm (when an infant is lying on his/her side). It should be noted that the device does not have to have four appendages, but this shape is preferable because lower appendages 5 can be draped around the waist of an infant; upper appendages 2 are intended to drape around the upper arms of a sleeping infant. Cavity 1 as shown in FIG. 1 is approximately the size of a newborn infant's torso, approximately four to six inches wide and approximatly seven to nine inches long. A seam 4 merely connects the material that covers the top of cavity 1 and appendages 2 and 5 with the material that covers the bottom of cavity 1 and appendages 2 and 5. Clips 3 in FIG. 1 are located at the sections of cavity 1 that would naturally represent the top and bottom of cavity 1 (i.e., one clip 3 between upper appendages 2 and one clip 3 between lower appendages 5 of the comforting device). Clips 3 do not have to connect directly to cavity 1. Clips 3, although pictured in FIG. 1 as metal or plastic clamps, could be any other sort of method that would secure the device to an infant's clothing or bedding. Placing clips 3 at the "top" and "bottom" of the comforting device may be the most effective in keeping the device secured upon an infant's torso. This positioning of clips 3 also makes the process of securing the comforting device on an infant simple; caregivers would be less likely to wake the sleeping baby while attempting to secure the device.

Figure 2:
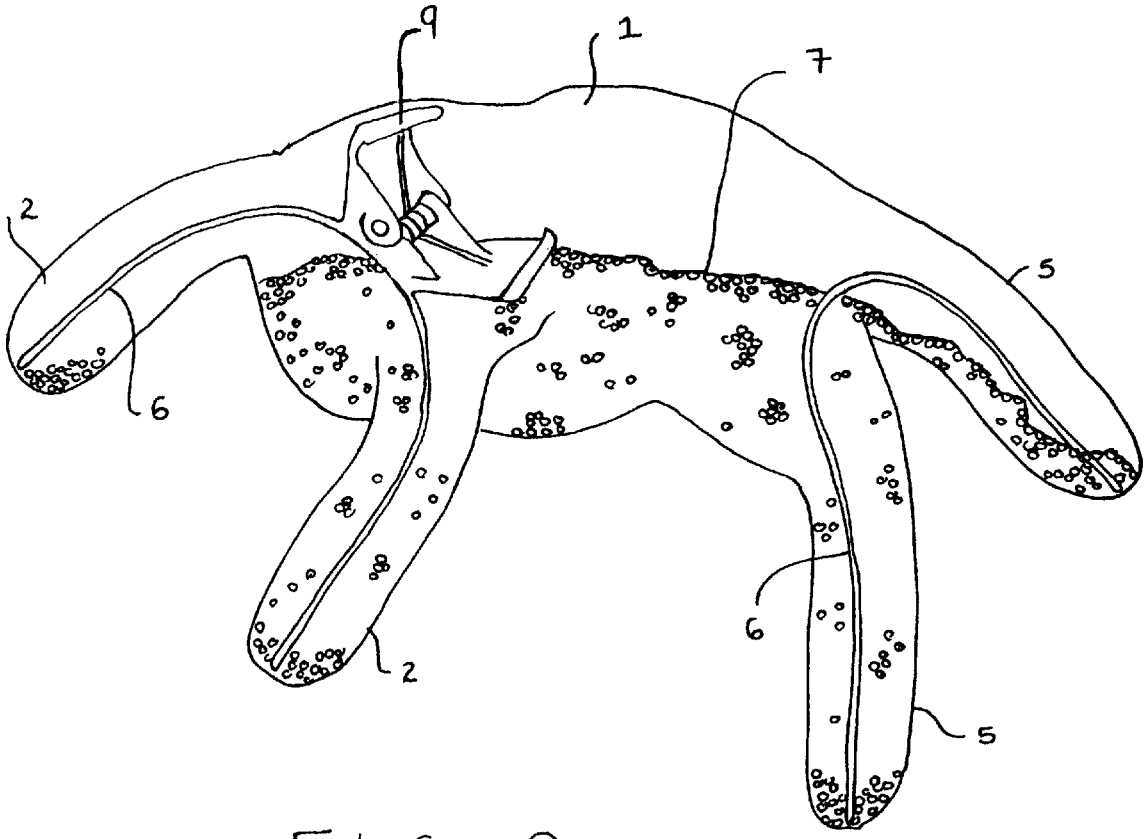
FIG 2 shows a top view of the internal structures of the comforting device of the present invention.

FIG. 2 shows the internal structure of the comforting device from a top view. Cavity 1 is partially filled with any freely flowable material 7, although it is shown as being filled with pellets. The comforting device must be able to mold to the curves of an infant's body, and thus must be made of flexible materials. Rod-like structures 6 shown in FIG. 2 are located within appendages 2 and 5 of the comforting device; one structure extends from the end of one upper appendage 2 to another, and another structure extends from one lower appendage 5 to another within the device. This allows upper and lower appendages 2 and 5 to hold their shape when bent around the torso of a sleeping infant. An infant feels "cradled" but not too restrained. Rod-like structures 6 also allow repeated adjustment of appendages 2 and 5. Rod-like structures 6 can be made of wire, plastic, or any other flexible material. Rod-like structures 6 can be attached to manipulation means, which is shown in FIG. 2 as being a spring-actioned clamp 9. Spring-actioned clamp 9 is located at the topside of cavity 1. Spring-actioned clamp 9 allows upper appendages 2 to be opened and closed around an infant's torso.

Figure 3:
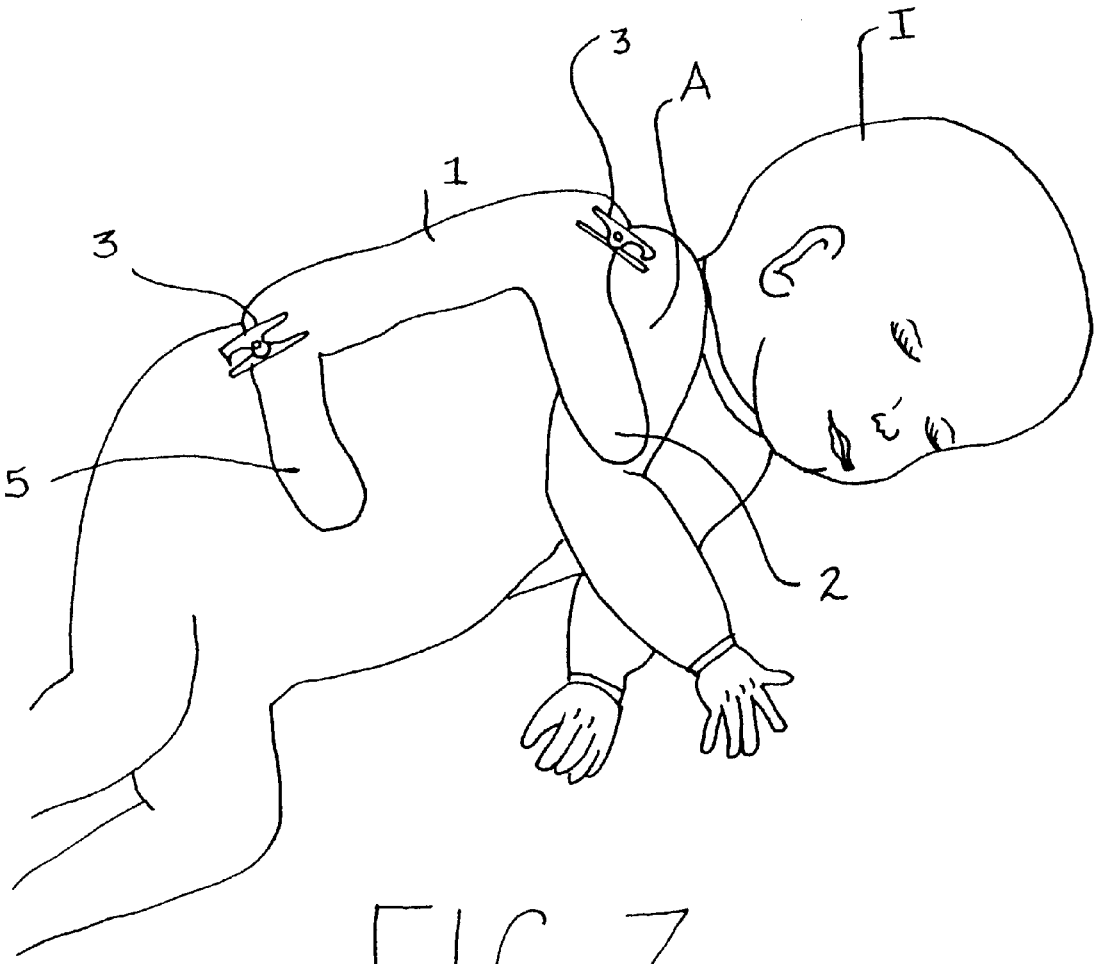
FIG. 3 shows the comforting device of the present invention being used on an infant sleeping on her side.

In FIG. 3, the comforting device is shown in use. The device is draped over an infant 1 who is sleeping on her side. Upper appendages 2 are draped and bent around the top portion of an infant's upper arm A to cradle the infant and provide a sense of security. Cavity 1 rests on the infant's side and contours the body—providing gentle pressure. Lower appendages 5 are shown draped and bent around the waist of the infant.

Figure 4:
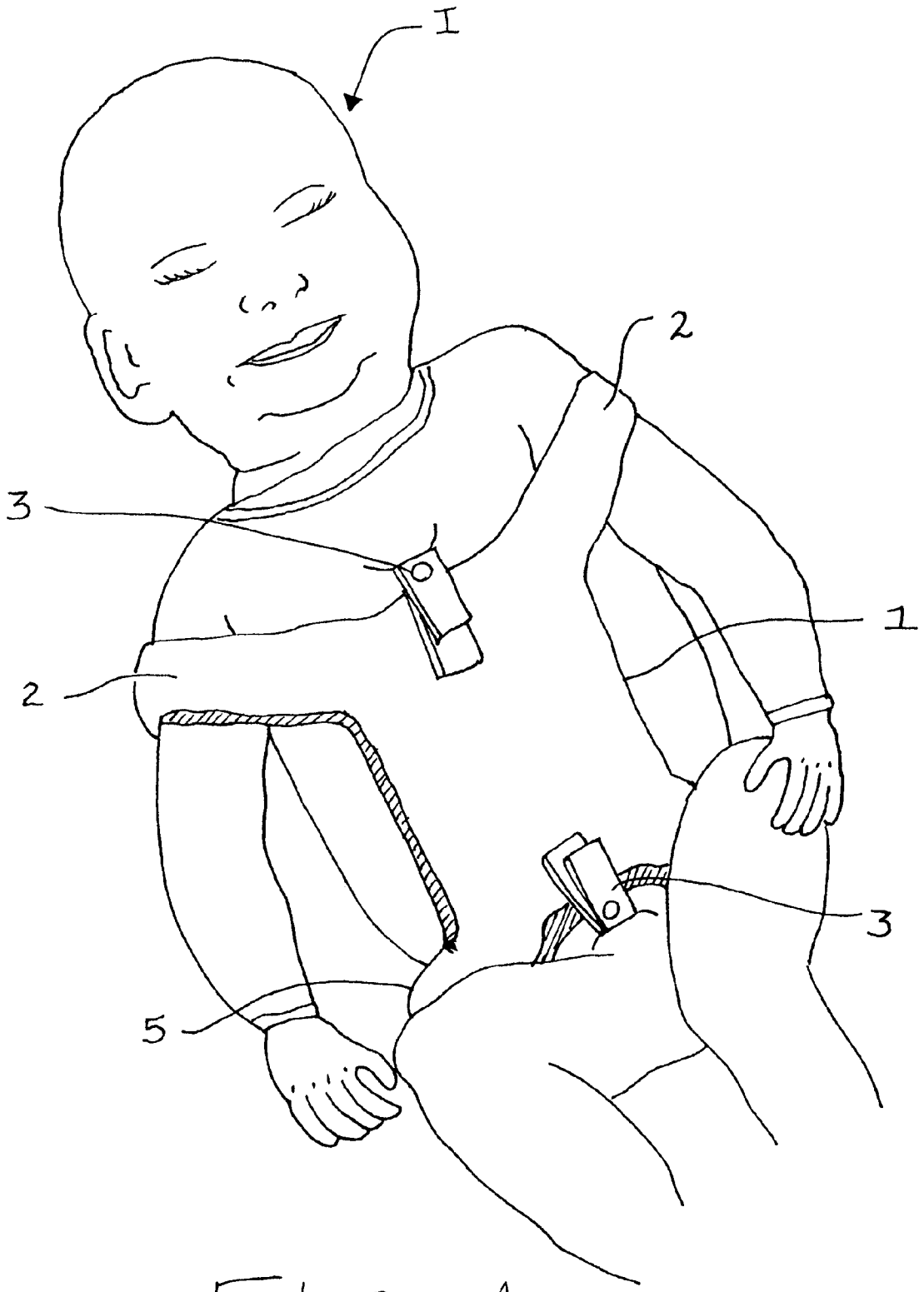
FIG. 4 shows the comforting device of the present invention being used on an infant sleeping on his back.

In FIG. 4, the comforting device is shown being used on a sleeping infant who is lying on his back. In this use, cavity 1 lies directly on the torso of sleeping infant 1. Upper appendages 2 are draped and bent around the upper portion of both of the infant's arms and around the infant's waist. Lower appendages 5 drape around the waist. Once again, in this position, the infant can be comforted by gentle pressure; the infant's arms are subtly restrained by upper appendages 2. Clips 3 are secured on the infant's clothes.

Figure 5:
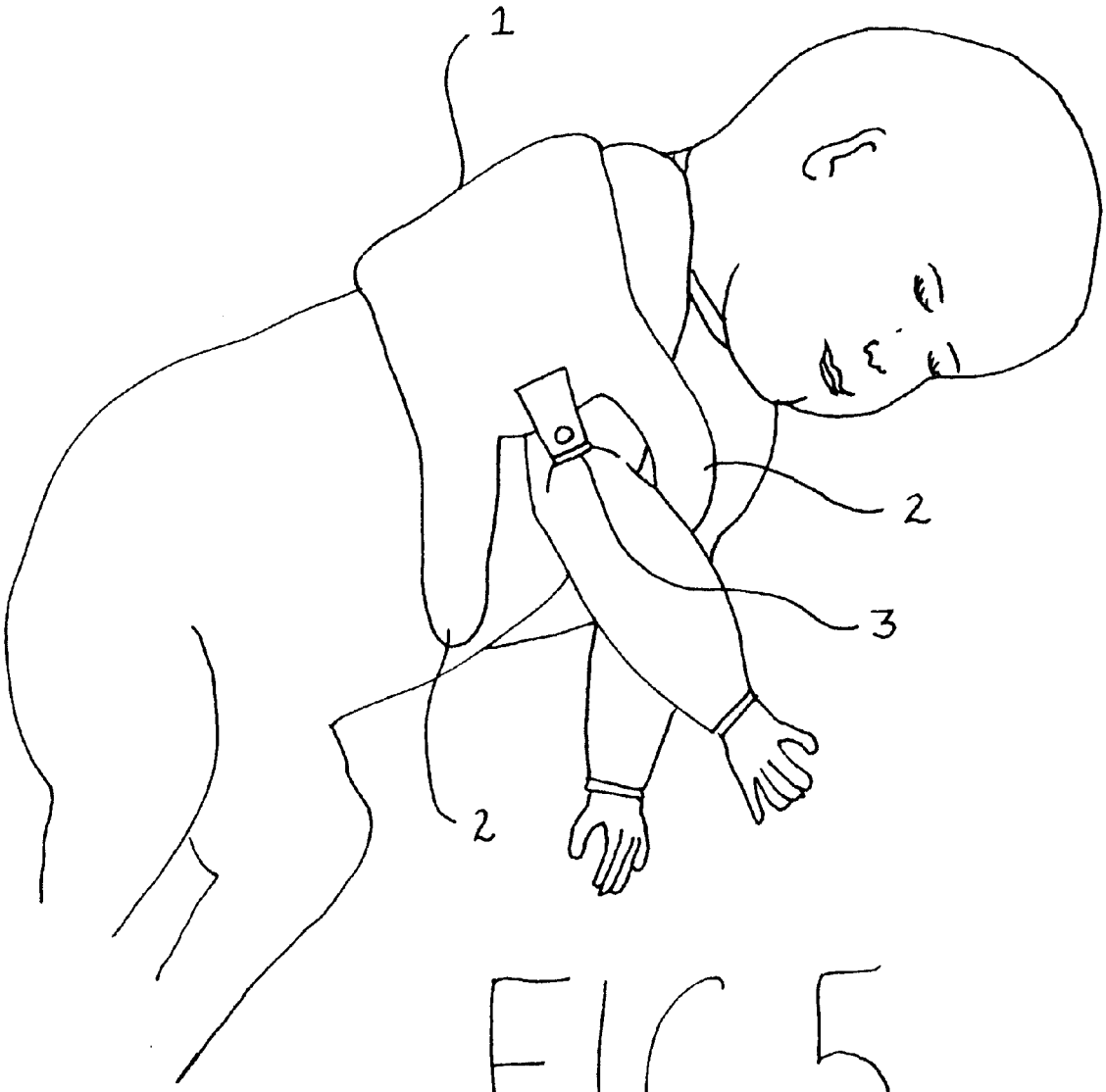
FIG. 5 shows the comforting device of the present invention being used horizontally across the torso of a sleeping infant; and, FIG. 6 shows the comforting device of the present invention that is designed to resemble a teddy bear.

The comforting device can also function appropriately if cavity 1 is draped horizontally over an infant's torso instead of vertically. FIG. 5 shows the comforting device used in this manner. In this use, appendages 2 and 5 would not require bending.

Figure 6:
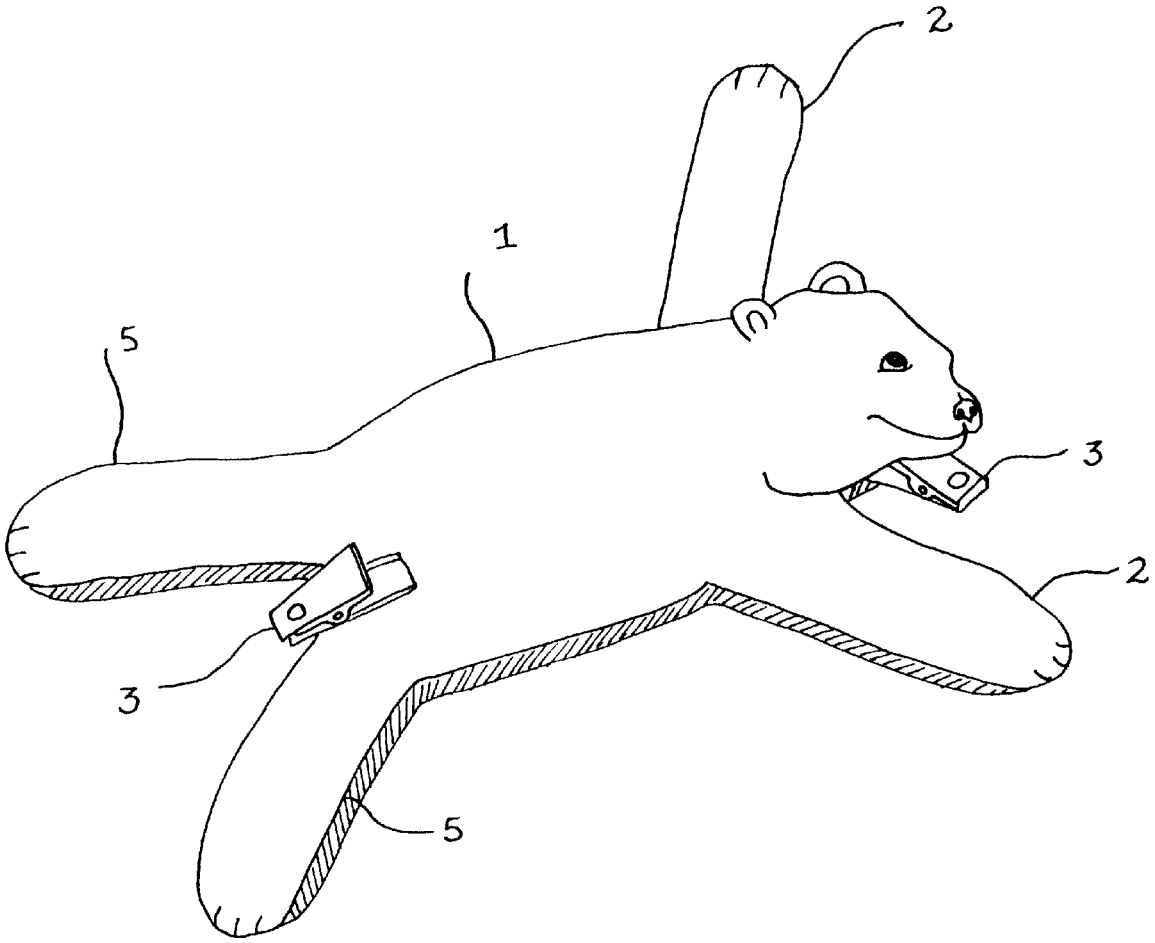

FIG. 6 shows a potential external design of the comforting device that would be functional yet appealing to infants. Appendages 2 and 5 and cavity 1 are made of a bright or animal-print material and resemble the body, arms, and legs of almost any animal. Clip 3 could even be designed to represent the mouth of an animal that opens and closes.

Operation of Invention—FIGS. 3, 4, 5

This sleep promoting and comforting device is designed for use on infants. A caregiver wishing to use the device on infant lying on her back (shown in FIG. 4) would first place cavity 1 vertically on the middle of the infant's torso. A caregiver would then gently bend upper appendages 2 around the upper portion of both of the infant's arms. Rod-like structures 6 allow upper appendages 2 to remain secure in their positioning. If manipulation means 9 of rod-like structures 6 is incorporated into the design, appendages 2 and 5 could be opened and then closed around the torso of the sleeping infant without having to be manually bent around infant 1. A caregiver would pinch together a spring-actioned clamp 9 located at the topside of the cavity of the comforting device. Clamp 9 (which is attached to rod-like structures 6) would cause the rod-like structures and thus appendages 2 to open when the clamp is squeezed together. When a caregiver releases clamp 9, appendages 2 close back together towards the horizontally respective appendage, thus cradling sleeping infant 1. Next, a caregiver would bend lower appendages 5 around the waist of infant 1. Finally, a caregiver would attach clips 3 to the infant's clothes. It will be appreciated by those ordinarily skilled in the art that a clamp 9 may be attached to the rod-like structures 6 which are contained within appendages 5. In such an optional configuration, the comforting device will provide additional functionality and ease of use in its intended purposes.

For an infant 1 lying on his side (shown in FIG. 3), a caregiver would place cavity 1 vertically on the side of the infant's torso. Next, a caregiver would bend upper appendages 2 around the upper portion of the top arm. A caregiver would then bend lower appendages 5 around the waist of infant 1. Finally, a caregiver would attach clips 3 to the infant's clothes.

For caregivers who prefer using the comforting device horizontally across an infant who is lying in any position, a caregiver would drape cavity 1 across an infant's torso (see FIG. 5). Appendages 2 and 5 would not need to be manipulated.

Conclusion, Ramifications, and Scope of Invention

Thus the reader will see that my infant sleep promoting and comforting device provides a sleeping infant with an increased sense of security through gentle pressure to the torso and subtle restraint to the arms. This increased sense of security may help alleviate infant waking as a result of the startle reflex. My comforting device is economical, convenient to transport, simple to use, and safe. It can be designed to resemble objects that are appealing to infants (e.g., teddy bears, cats, and cows), which makes my device not only functional but pleasing to and interesting for an infant.

Although my previous description contains many specificities, these should not be construed as limitations on the scope of the invention, but rather as an exemplification of one preferred embodiment thereof. Many other variations are possible. For example, the appendages of the device are not absolutely necessary. A cavity of increased size would most likely suffice in providing enough pressure and restraint to a sleeping infant—although such a design may limit the flexibility of the device. The attaching means can be located in any position on the comforting device—directly or indirectly—and can be clamps or any other structure that will secure the comforting device to the infant or bedding. The filler material can be any material that would provide sufficient flexibility and weight to the device. The appendages can be integrally connected to the cavity or can be attached to the cavity by a seam or some sort of flexible material (e.g., elastic).

Accordingly, the scope of my invention should be determined not by the embodiments illustrated, but by the appended claims and their legal equivalents.

I claim:

1. A sleep promoting and comforting device for infants, comprising:

a bag formed of flexible material having at least a first portion and a second portion which are joined together to form a substantially enclosed cavity, said cavity having a plurality of upper appendages and a plurality of lower appendages depending therefrom;

flowable material means partially filling said cavity and said plurality of upper and lower appendages, said flowable material means is a solid particulate;

a plurality of clip means depending from said bag; and, a first elongated rod-like structure within and between said upper appendages, and a second elongated rod-like structure within and between said lower appendages, each of said first and second elongated rod-like structures being moveable between at least two positions;

whereby said sleep promoting and comforting device may either drape over and conform to the curves of an infant's body, or may be attached to an infant's clothing or covers in order that the device will remain secured upon the infant's torso region.

2. The device of claim 1 wherein said bag is approximately four to six inches wide and approximately seven to nine inches long.

3. The device of claim 1 wherein said flowable material means is polystyrene pellets.

4. The device of claim 1 wherein said appendages are of sufficient length to extend around most of an infant's body.

5. The device of claim 1 wherein said first and second elongated rod-like structures are wire.

6. The device of claim 1 further including manipulation means for controlling the movement of said elongated rod-like structures.

7. The device of claim 6 wherein said manipulation means is a spring-actioned clamp.

8. A sleep promoting and comforting device for infants, comprising:

a flexible bag comprising a substantially enclosed cavity, said bag having at least two appendages;

flowable material means partially filling said cavity and said at least two appendages, said flowable material means comprising a solid particulate;

an elongate rod-like structure within and between said at least two appendages, said elongate rod-like structure being moveable between at least two positions, whereby said sleep promoting and comforting device may be draped over and conformed to the curves of an infant's body.

9. The device of claim 8, further comprising attaching means depending from said bag, wherein said sleep promoting and comforting device is capable of binary removably affixed adjacent an infant's clothing or covers to secure the device upon the infant's torso region.

10. The device of claim 8, wherein said flexible bag is approximately four to six inches wide and approximately seven to nine inches long.

11. The device of claim 8, wherein said flowable material means is polystyrene pellets.

12. The device of claim 8 wherein said appendages are of sufficient length to extend partially around at least one arm of an infant.

13. The device of claim 8 wherein said elongate rod-like structure is wire.

14. The device of claim 8, further comprising manipulation means for controlling the movement of said elongate rod-like structure.

15. The device of claim 14, wherein said manipulation means is a spring-actioned clamp.

16. A sleep promoting and comforting device for infants, comprising:

a bag formed of flexible material comprising a substantially enclosed cavity, said cavity having a plurality of appendages depending therefrom;

flowable material means partially filling said cavity and said plurality of appendages, said flowable material means comprising a solid particulate; and, an elongate rod-like structure within and between at least two of said plurality of appendages, said elongate rod-like structure being moveable between at least two positions, whereby said sleep promoting and comforting device may be draped over and conformed to the curves of an infant's body.

17. The device of claim 6, further comprising attachment means depending from said bag, wherein said sleep promoting and comforting device is capable of being removably affixed adjacent an infant's clothing or covers to secure the device upon the infant's torso region.

18. The device of claim 16, wherein said bag is approximately four to six inches wide and approximately seven to nine inches long.

19. The device of claim 16, wherein said flowable material means is polystyrene pellets.

20. The device of claim 16, wherein said appendages are of sufficient length to extend partially around at least one arm of an infant.

21. The device of claim 16, wherein said elongate rod-like structure is wire.

22. The device of claim 16, further comprising manipulation means for controlling the movement of said elongate rod-like structure.

23. The device of claim 17, wherein said manipulation means is a spring-actioned clamp.

* * * * *